US005827038A

United States Patent [19]

Barden

[11] Patent Number: 5,827,038

[45] Date of Patent: Oct. 27, 1998

[54] AUGER BUCKET

[75] Inventor: William M. Barden, Raleigh, N.C.

[73] Assignee: Caterpillar Inc., Peoria, Ill.

[21] Appl. No.: 811,854

[22] Filed: Mar. 5, 1997

Related U.S. Application Data

[60] Provisional application No. 60/033,880 Nov. 23, 1996.

[51] Int. Cl.[6] ..... E02F 3/00

[52] U.S. Cl. ..... 414/725; 37/903; 414/526

[58] Field of Search ..... 414/725, 526, 414/326, 912; 198/669, 676; 222/413, 330; 37/403, 903, 901; 141/256

[56] References Cited

U.S. PATENT DOCUMENTS

| | | | |
|---|---|---|---|
| 3,194,385 | 7/1965 | Barnese | 198/676 X |
| 3,198,358 | 8/1965 | Gardner | 214/140 |
| 3,402,841 | 9/1968 | Salna et al. | 214/768 |
| 3,559,893 | 2/1971 | Gruben | 198/669 X |
| 3,738,513 | 6/1973 | Wagner | 214/146 |
| 4,055,255 | 10/1977 | Vasquez | 414/725 X |
| 4,140,214 | 2/1979 | Pellhammer | 414/326 X |
| 4,782,606 | 11/1988 | Surface | 37/117.5 |
| 4,854,404 | 8/1989 | Weber | 175/327 |
| 4,864,748 | 9/1989 | Boyer | 414/526 X |
| 5,353,851 | 10/1994 | Cline | 141/256 |

*Primary Examiner*—Donald W. Underwood
*Attorney, Agent, or Firm*—Diana L. Charlton

[57] ABSTRACT

An improved means for dispensing a substantially even flow of semi-liquid material such as, concrete, into remote areas includes the use of an auger assembly mounted within a bucket of a construction machine. The auger assembly has a tubular housing with sealed end portions and an intermediate portion. The intermediate portion has a receiving passage defined therein. An auger is mounted within the tubular housing and has a blade portion which is rotatable in either a first or second direction by power supplied through a bi-directional motor. The semi-liquid material is poured into the bucket and enters the auger only through the receiving passage. The direction of rotation is chosen by an operator so that the material is conveyed along a rotational axis toward either a first or second opening, respectively, adjacent a remote area. The semi-liquid material flows substantially evenly through either the first or second openings to fill the remote area uniformly.

7 Claims, 4 Drawing Sheets

AUGER BUCKET

CROSS REFERENCE TO RELATED APPLICATIONS

This application is based, in part, on the material disclosed in United States provisional patent application Ser. No. 60\033,880 filed Nov. 23, 1996.

1. Technical Field

This invention relates generally to construction machines and more particularly to the use of a bucket attachment on the machine for dispensing a substantially even flow of semi-liquid material from either side of the bucket to an adjacent area remote from the bucket, respectively.

2. Background Art

In order to dispense a semi-liquid, such as concrete, into difficult to reach locations, an operator may have to shovel the concrete into a footing or the like from a bucket of a construction machine. The method of creating the footing or the like in this manner may cause non-uniformity and may limit the effectiveness of the "pour". In order to increase the efficiency of this process and to decrease time and energy, it is advantageous to provide a single bucket capable of accomplishing all of the necessary pouring requirements. This bucket must have the ability to provide a uniform "pour" by including an apparatus within the bucket for even distribution of concrete to a remote and hard to reach location.

An example of a bucket with an improved material filling apparatus is disclosed in U.S. Pat. No. 5,353,851 issued Oct. 11, 1994 to Richard W. Cline.

This apparatus is installed on a front end multipurpose or fixed loader bucket. A hydraulic or electric motor is provided to rotate an auger, which discharges material out of a discharge opening at one side of the bucket to fill sand bags or containers that are placed underneath the opening. The apparatus is enclosed within the bucket by a cage-like rock guard. Material is poured into the bucket at any location and is diverted to the opening at any position along the auger. This method of dispensing material can limit the uniformity of the pouring since excess material may escape through the opening without proper channeling through the auger.

The present invention is directed to overcoming the problem as set forth above.

DISCLOSURE OF THE INVENTION

In one aspect of the present invention, a bucket assembly is used with a construction machine with a pair of articulated arms. A bucket is pivotably attached to an end of one of the pair of articulated arms. The bucket has a front wall and a rear wall spaced from the front wall to define an inner chamber therebetween for receiving material. The inner chamber defines first and second openings therethrough. An auger assembly is secured within the inner chamber of the bucket. The auger assembly has a tubular housing with first and second substantially sealed end portions encapsulating respectively the first and second openings in the bucket and an intermediate portion defining a receiving passage in communication with the first and second end portions and a rotatable auger supported within the tubular housing at the first and second end portions. Means mounted within the bucket is provided for transmitting power to the rotatable auger. The rotatable auger has a blade portion operatively associated with the transmitting means for rotation in a first direction to move the material toward the first end portion and or rotation in a second direction to move the material toward the second end portion.

In another aspect of the present invention, a method for dispensing a semi-liquid material from a bucket of a construction machine to an adjacent area remote from the bucket is disclosed. This is accomplished by mounting an auger assembly into an inner chamber of the bucket. The auger assembly has a tubular housing with first and second substantially sealed end portions encapsulating respectively first and second openings in the bucket and an intermediate portion defining a receiving passage in communication with the first and second end portions and a rotatable auger having a blade portion supported within the tubular housing at the first and second end portions. Next, pouring a semi-liquid material into the inner chamber of the bucket so that the material enters the tubular housing at the receiving passage in the intermediate portion. Then, transmitting power to the rotatable auger through a transmitting means for rotating the blade portion of the auger in a specific direction for conveying the material longitudinally along a rotational axis of the auger from the receiving passage at the intermediate portion toward one of either the first or second end portions. Finally, dispensing a substantially even flow of material into the adjacent area from the one of either the first and second end portions through the respective first and second openings in the bucket.

In yet another aspect of the present invention, a bucket assembly comprises a bucket having a front wall and a rear wall spaced from the front wall to define an inner chamber therebetween for receiving material. The inner chamber defines first and second openings therethrough. An auger assembly is secured within the inner chamber of the bucket. The auger assembly has a tubular housing with first and second substantially sealed end portions encapsulating respectively the first and second openings in the bucket and an intermediate portion defining a receiving passage in communication with the first and second end portions and a rotatable auger supported within the tubular housing at the first and second end portions. Means is mounted within the bucket for transmitting power to the rotatable auger. The rotatable auger has a blade portion which is operatively associated with the transmitting means for rotation in a first direction to move the material toward the first end portion and for rotation in a second direction to move the material toward the second end portion.

The present invention provides a means to. The design and construction of the bucket eliminates the need for more than one attachment and simplifies the excavation process.

BEST MODE FOR CARRYING OUT THE INVENTION

Figure 1:
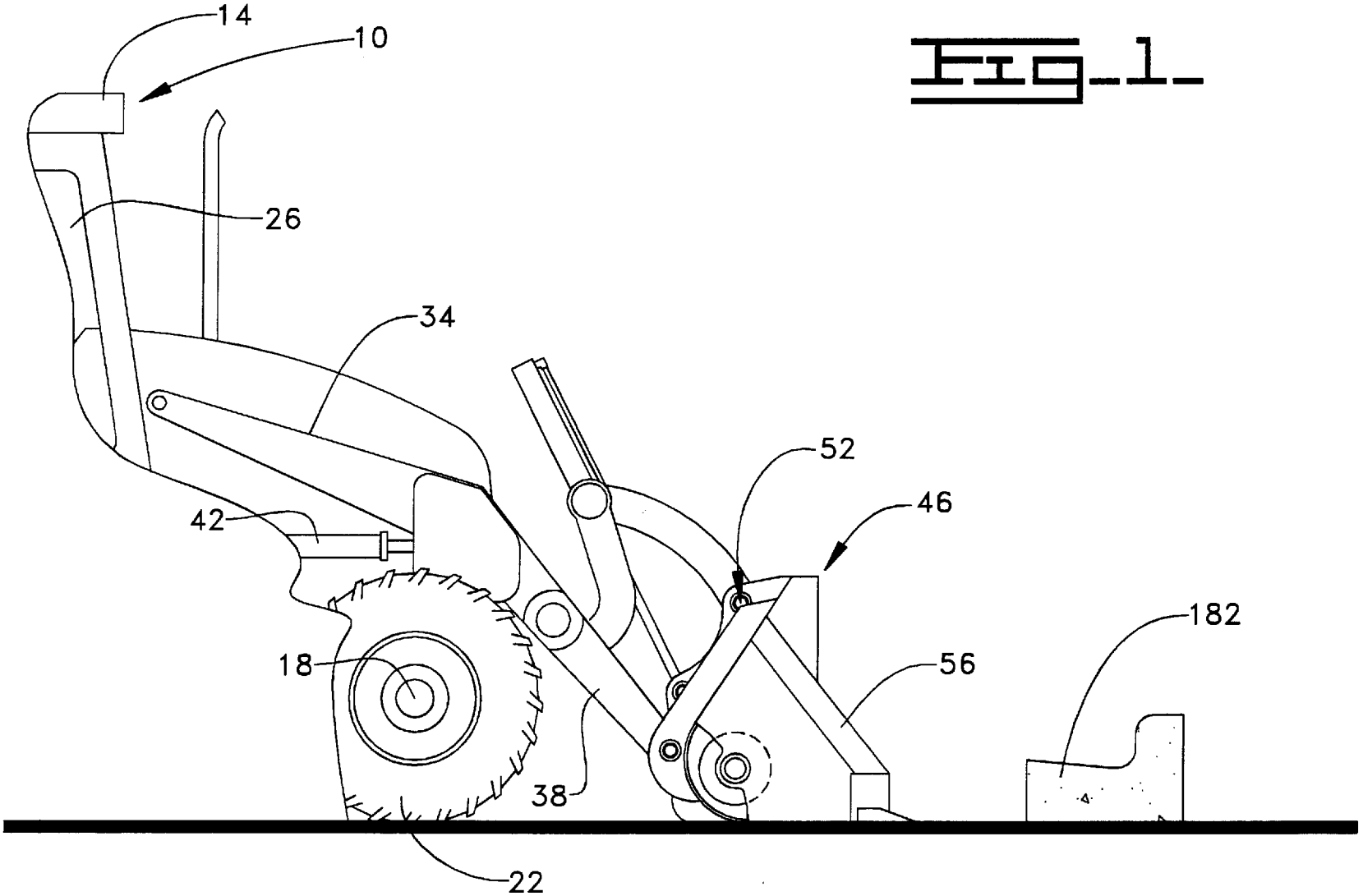
FIG. 1 is a partial view of a construction machine embodying the present invention.

A construction machine 10 is shown in FIG. 1. The construction machine 10 shown is an excavator, however, it should be understood that any suitable construction machine may be used. The construction machine 10 includes a support frame 14 attached to a pair of axles, one of which is shown at 18, mounting a set of wheels 22. A cab assembly 26 is supported on the frame 14. A pair of stabilizers, one of which is shown at 30, are movably attached to the frame 14 rearwardly from the cab assembly 26. A pair of articulating arms 34 are pivotally connected to the frame 14. The articulating arms include a boom 38 and a stick 42 which extend from the rear of the cab assembly 26 a predetermined distance. A bucket assembly 46 is pivotally attached to the end of the boom 38 through a series of connection pins 52.

Figure 2:
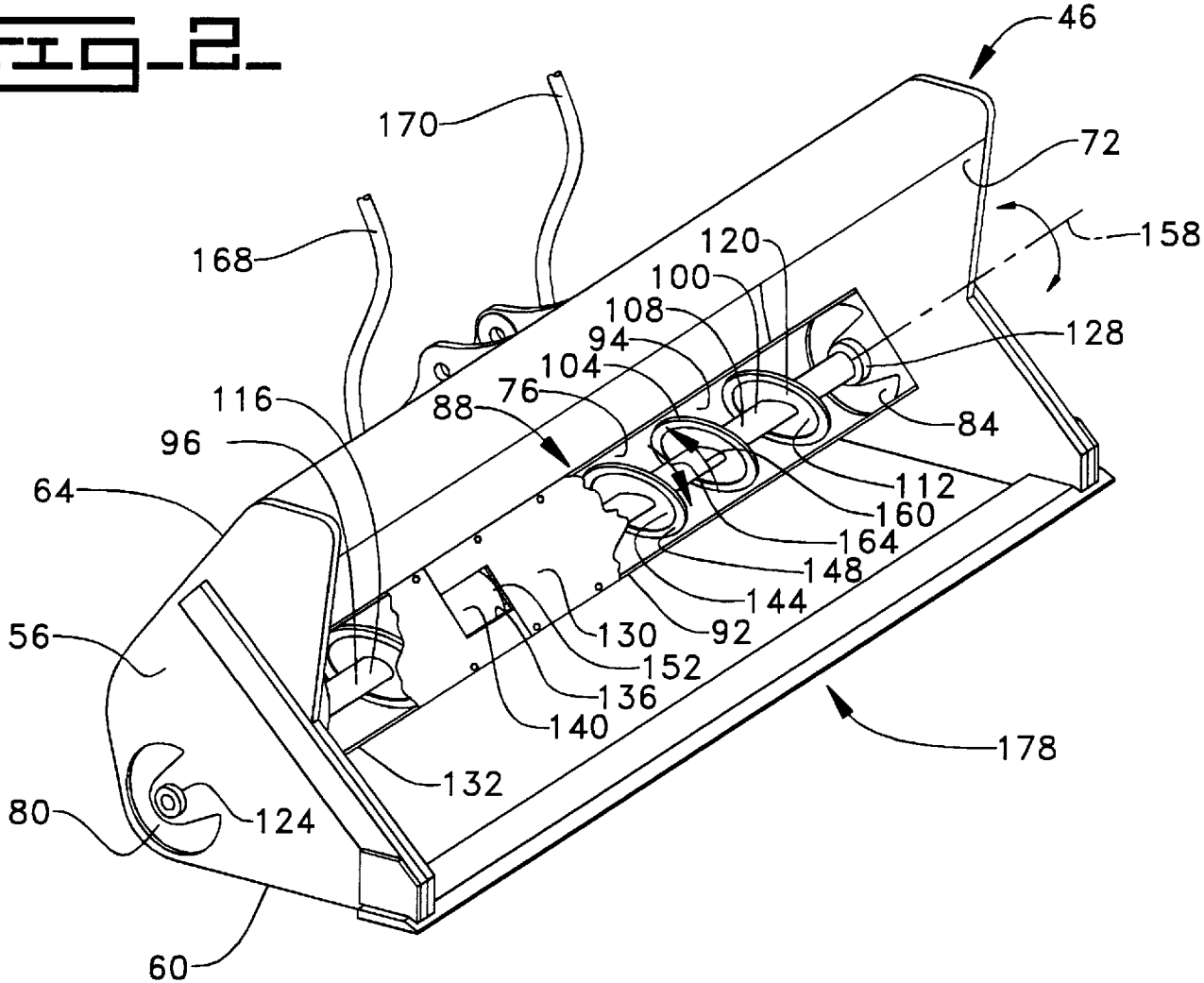
FIG. 2 is a front view of a bucket assembly for the construction machine embodying the present invention.
Figure 3:
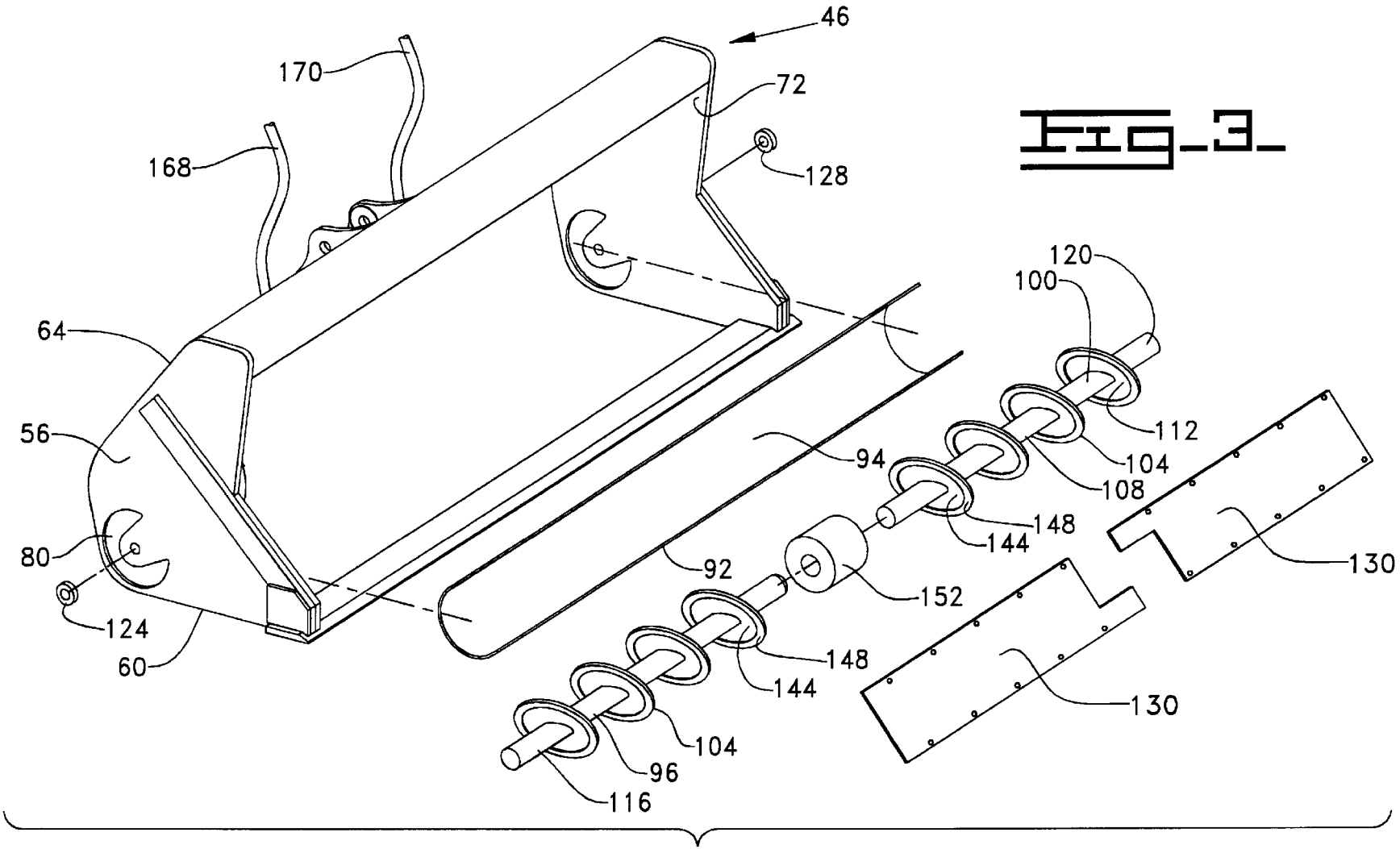
FIG. 3 is an exploded view of the present invention embodied in the bucket assembly of FIG. 2.

Referring more specifically to FIGS. 2 and 3, the bucket assembly 46 includes a bucket 56 which has a front wall 60, a rear wall 64 spaced from the front wall 60 and first and second side walls 68,72 connecting the front and rear walls 60,64 to define an inner chamber 76. First and second openings 80,84 are defined within the inner chamber 76 through the first and second side walls 68,72, respectively, which allow communication between the inner chamber 76 and the atmosphere. An auger assembly 88 is secured within the inner chamber 76 in any conventional manner, such as welding, and runs the length of the bucket 56. The auger assembly 88 includes a tubular housing 92 with an inner surface 94 and substantially sealed first and second end portions 96,100. An auger 104 having a shaft 108 and a blade portion 112 is rotatably mounted within the tubular housing 92 at a first and second end 116,120 of the shaft 108 through a pair of shaft bearings 124,128 in a well-known manner. The first and second end portions 96,100 of the tubular housing 92 substantially encapsulate the first and second openings 80,84, respectively, to limit communication between the bucket 56 and the auger 104 through the connection of a pair of covers 130. The pair of covers 130 may be connected to the tubular housing 92 in any suitable manner, such as bolting. An intermediate portion 132 of the tubular housing 92 defined at the junction between the pair of covers 130 includes a receiving passage 136 therein to allow communication between the bucket 56 and the auger 104 at a specific position 140. Although the specific position 140 shown is at the intermediate portion 132 of the tubular housing 92, it should be understood that any suitable position may be used along the length of the tubular portion 92. The blade portion 112 of the auger 104 has a metallic blade 144 with an elastomeric outer edge portion 148 attached thereto in any conventional manner. The outer edge portion 148 contacts the inner surface 94 of the tubular housing 92 and has a predetermined resiliency thereagainst. It should be understood that the elastomeric material of the outer edge portion 148 may be of any suitable type, such as rubber, nylon, etc., with adequate resiliency.

A bi-directional motor 152 of any suitable type, but preferably, hydraulic is positioned and secured within the bucket and is connected to the shaft 108 of the auger 104 in a conventional manner to provide a means to rotate the blade portion 112 along a rotational axis 158 in one of a first or second direction, indicated by arrows 160,164. Hoses 168, 170 transmit hydraulic power to the motor 152 in a conventional manner to provide a hydraulic circuit (not shown) operable from the cab assembly 26 of the machine 10.

A method 178 for dispensing an even flow of semi-liquid material, such as, concrete, from the bucket 156 to a remote area 182 outside the bucket 156 is achieved in the operation of the present invention. It should be understood that any other type of material may be used in conjunction with the bucket 56.

Figure 4:
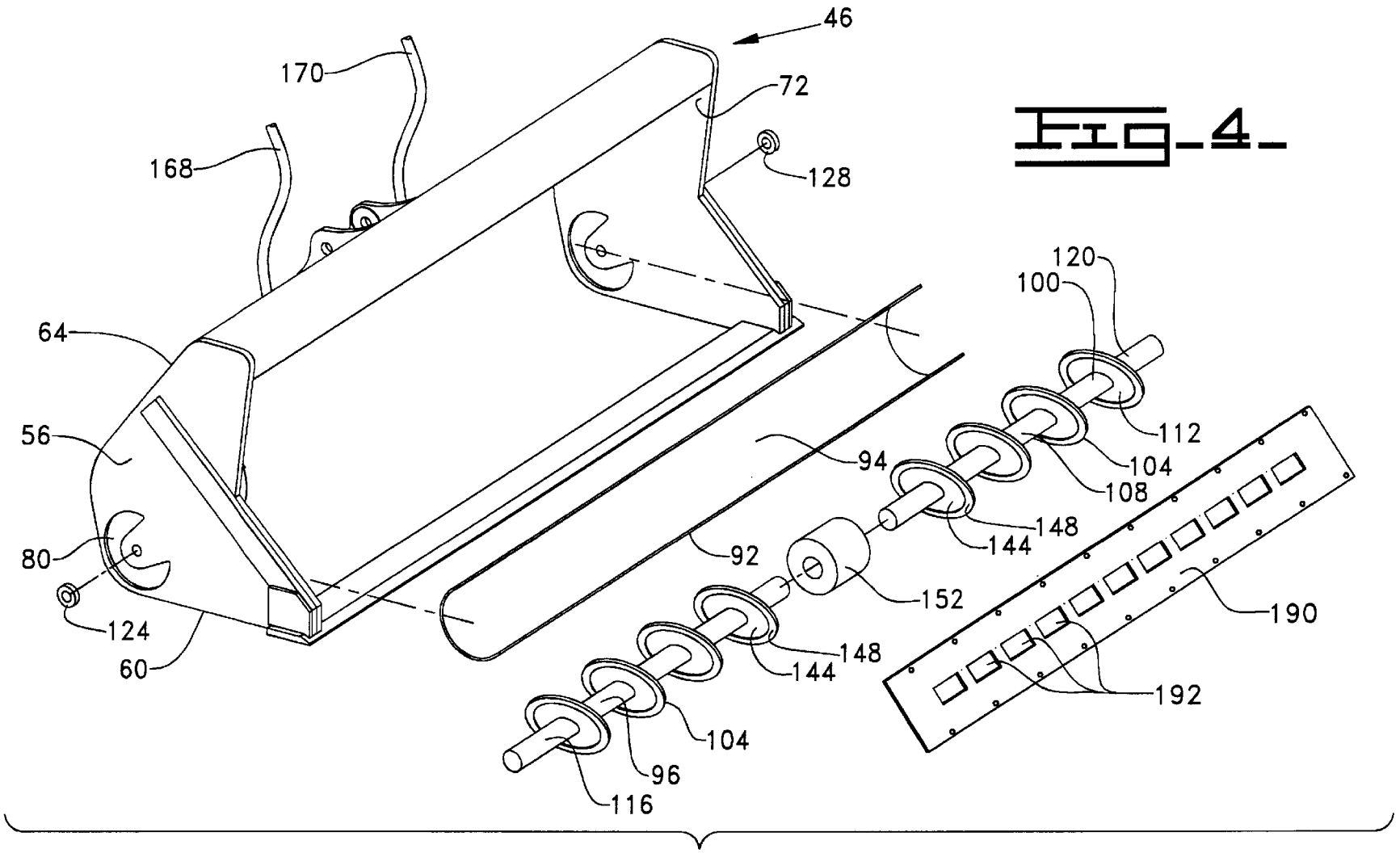
FIG. 4 is an alternate exploded view of the present invention embodied in the bucket assembly of FIG. 2.

An alternate embodiment of the auger assembly 88 can be seen in FIG. 4. It should be understood that any features of FIG. 4 which are the same as those shown in FIG. 3 will include identical reference numbers. A cover 190 is connected to the tubular housing 92 in any suitable manner, such as bolting include, and includes a plurality of slots 192 extending therethrough intermittently spaced along the length of the cover 190. These slots 192 provide communication between the bucket 56 and the auger assembly 88.

Industrial Applicability

In operation, the semi-liquid material is poured into the inner chamber 76 of the bucket 56. The construction machine 10 is positioned so that either the first or the second openings 80,84 within the bucket 56 is adjacent the remote area 182. The hydraulic circuit (not shown) is activated by an operator to supply power to the motor 152. Dependent on the position of the construction machine 10 and the opening 80,84 to be used, the operator activates the motor 152 in the appropriate first or second direction 160,164 to rotate the shaft 108 of the auger 104, respectively. Semi-liquid material enters the auger 104 through only the receiving passage 136 of the intermediate portion 132. The sealed first and second end portions 96,100 of the tubular housing 92 in combination with the connected pair of covers 130 restrict entry of the semi-liquid material into the auger 104 at any position other than the position 140 of the receiving passage 136. Due to the rotation in either the first or the second direction 160,164, the semi-liquid material is conveyed along the rotational axis 158 toward either the first or second openings 80,84. The elastomeric outer edge portion 148 continuously scrapes the inner surface 94 of the tubular housing 92 to remove excess material therefrom. This scraping action distributes the excess material back into the rotational axis 158 of the auger shaft 108. The entry of the semi-liquid material at only the receiving passage 136 and the scraping action of the outer edge portion 148 allows for a substantially even flow of semi-liquid material to be dispensed through either the first or second opening 96,100 and into the remote area 182. The pair of covers 130 may be removed in order to clean the auger blade 144 or during maintenance of the motor 152 or other components.

The cover 190, shown in FIG. 4, may be used in particular instances where the semi-liquid material has a thicker density to ensure the flow of material into the auger assembly through the plurality of slots 192.

In view of the above, the use of an auger assembly within a bucket that has sealed end portions and a specific receiving passage for permitting a semi-liquid material therein allows for the dispensing of a substantially even flow of semi-liquid material through defined openings in the bucket and into a remote area. The ability of dispensing the semi-liquid material in such a manner increases the effectiveness of the operation and the uniformity of the dispensed material.

I claim:

1. A bucket assembly for use with a construction machine having a pair of articulated arms, comprising:

a bucket pivotably attachable to an end of each of the pair of articulated arms, the bucket having a front wall and a rear wall spaced from the front wall to define an inner chamber therebetween for receiving material with the inner chamber defining first and second openings therethrough, an auger assembly secured within the inner chamber of the bucket, the auger assembly having a tubular housing with first and second substantially sealed end portions encapsulating respectively the first and second openings in the bucket and an intermediate portion defining a receiving passage in communication with the first and second end portions and a rotatable auger supported within the tubular housing at the first and second end portions;

means mounted within the bucket for transmitting power to the rotatable auger; and the rotatable auger having a blade portion being operatively associated with the transmitting means for rotation in a first direction to move the material toward the first end portion and for rotation in a second direction to move the material toward the second end portion.

2. A bucket assembly for use with a construction machine as set forth in claim 1, wherein the blade portion has a outer edge in contact with an inner surface of the tubular housing.

3. A bucket assembly for use with a construction machine as set forth in claim 2, wherein the outer edge of the blade portion is made from a non-metallic material.

4. A bucket assembly for use with a construction machine as set forth in claim 3, wherein the non-metallic material is rubber.

5. A method for dispensing a semi-liquid material from a bucket of a construction machine to an adjacent area remote from the bucket, comprising the steps of:

mounting an auger assembly into an inner chamber of the bucket, the auger assembly having a tubular housing with first and second substantially sealed end portions encapsulating respectively first and second openings in the bucket and an intermediate portion defining a receiving passage in communication with the first and second end portions and a rotatable auger having a blade portion supported within the tubular housing at the first and second end portions;

pouring a semi-liquid material into the inner chamber of the bucket so that the material enters the tubular housing at the receiving passage in the intermediate portion;

transmitting power to the rotatable auger through a transmitting means for rotating the blade portion of the auger in a specific direction for conveying the material longitudinally along a rotational axis of the auger from the receiving passage at the intermediate portion toward one of either the first or second end portions; and dispensing a substantially even flow of material into the adjacent area from the one of either the first and second end portions through the respective first and second openings in the bucket.

6. The method of dispensing a semi-liquid material from a bucket as set forth in claim 5, wherein the step of dispensing a substantially even flow of material includes the step of:

attaching a rubber wiper at an outer portion of the blade portion for contact with an inner surface of the tubular housing during rotation for preventing excess material from dispensing through the first and second openings.

7. A bucket assembly, comprising:

a bucket having a front wall and a rear wall spaced from the front wall to define an inner chamber therebetween for receiving material with the inner chamber defining first and second openings therethrough, an auger assembly secured within the inner chamber of the bucket, the auger assembly having a tubular housing with first and second substantially sealed end portions encapsulating respectively the first and second openings in the bucket and an intermediate portion defining a receiving passage in communication with the first and second end portions and a rotatable auger supported within the tubular housing at the first and second end portions;

means mounted within the bucket for transmitting power to the rotatable auger; and the rotatable auger having a blade portion being operatively associated with the transmitting means for rotation in a first direction to move the material toward the first end portion and for rotation in a second direction to move the material toward the second end portion.

* * * * *